US005537194A

United States Patent [19]

Henry et al.

[11] Patent Number: 5,537,194

[45] Date of Patent: Jul. 16, 1996

[54] LIQUID DEVELOPER COMPATIBLE INTERMEDIATE TONER TRANSFER MEMBER

[75] Inventors: Arnold W. Henry; Santokh S. Badesha, both of Pittsford; George J. Heeks, Rochester, all of N.Y.

[73] Assignee: Xerox Corporation, Stamford, Conn.

[21] Appl. No.: 540,999

[22] Filed: Oct. 11, 1995

[51] Int. Cl.[6] ..... G03G 15/10; G03G 15/14

[52] U.S. Cl. ..... 355/271; 355/256; 428/421

[58] Field of Search ..... 355/256, 271–279; 430/124, 126; 219/216; 428/421

[56] References Cited

U.S. PATENT DOCUMENTS

| | | | |
|---|---|---|---|
| 3,893,761 | 7/1975 | Buchan et al. | 355/272 |
| 4,684,238 | 8/1987 | Till et al. | 355/275 |
| 4,690,539 | 9/1987 | Radulski | 355/272 |
| 4,708,460 | 11/1987 | Langdon | 355/271 |
| 4,853,737 | 8/1989 | Hartley et al. | 355/289 |
| 5,099,286 | 3/1992 | Nishise et al. | 355/272 |
| 5,119,140 | 6/1992 | Berkes et al. | 355/273 |
| 5,132,743 | 7/1992 | Bujese et al. | 355/274 |
| 5,150,161 | 9/1992 | Bujese | 355/256 |
| 5,233,397 | 8/1993 | Till | 355/279 |
| 5,253,021 | 10/1993 | Aslam et al. | 355/271 |
| 5,340,679 | 8/1994 | Badesha et al. | 430/126 |
| 5,366,772 | 11/1994 | Badesha et al. | 428/35.8 |
| 5,410,392 | 4/1995 | Landa | 355/271 |
| 5,456,987 | 10/1995 | Badesha | 428/421 |
| 5,478,652 | 12/1995 | Grootaert et al. | 428/422 |

*Primary Examiner*—Joan H. Pendegrass
*Assistant Examiner*—Sophia S. Chen
*Attorney, Agent, or Firm*—Zosan S. Soong

[57] ABSTRACT

There is disclosed an intermediate toner transfer member comprising: (a) a substrate; and (b) an outer layer comprised of a haloelastomer having pendant hydrocarbon chains covalently bonded to the backbone of the haloelastomer.

11 Claims, 1 Drawing Sheet

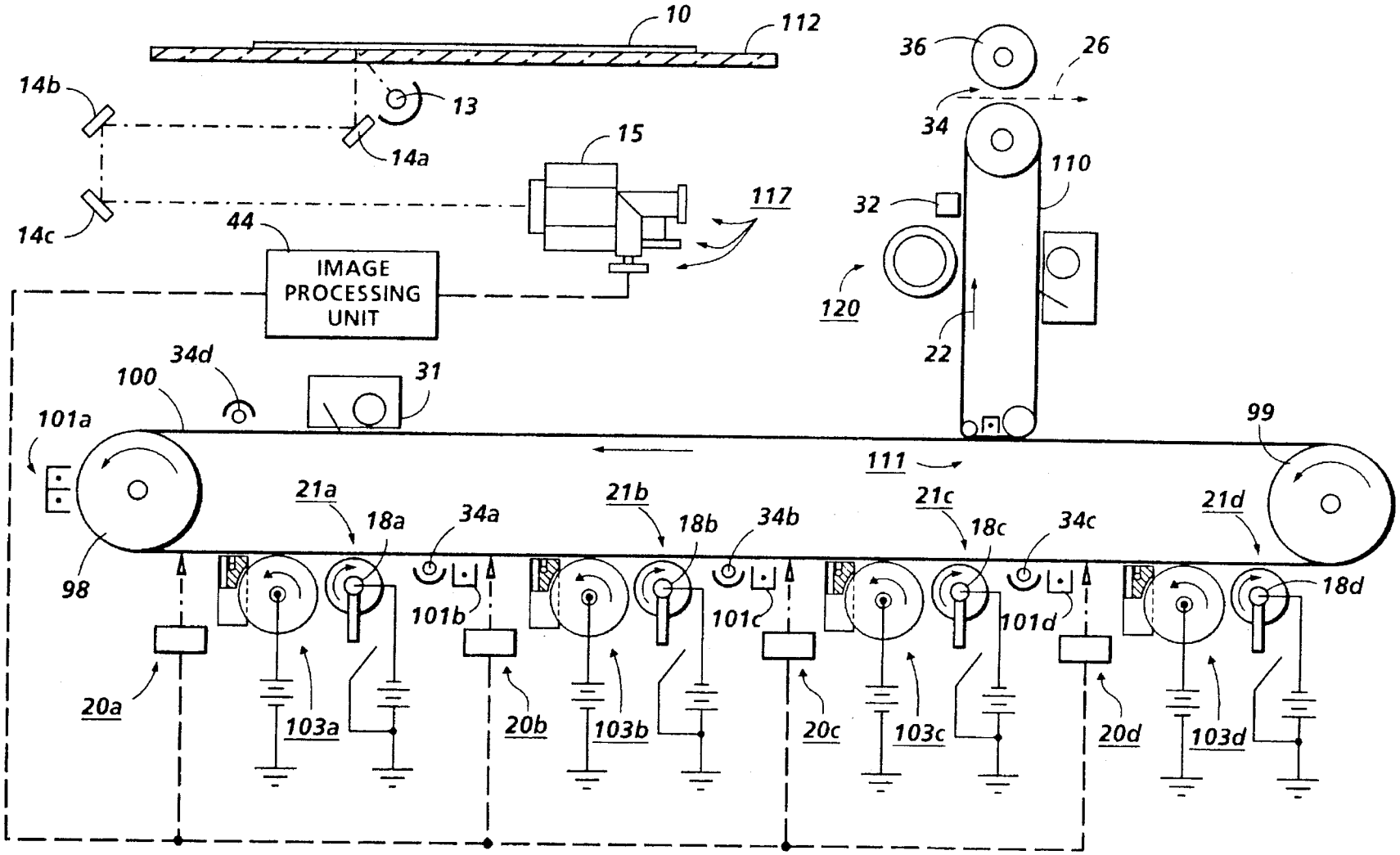
IMAGE PROCESSING UNIT
10
112
13
14a
14b
14c
15
117
44
26
36
34
110
32
22
120
31
34d
100
101a
98
99
111
21a
21b
21c
21d
18a
18b
18c
18d
34a
34b
34c
101b
101c
101d
103a
103b
103c
103d
20a
20b
20c
20d

LIQUID DEVELOPER COMPATIBLE INTERMEDIATE TONER TRANSFER MEMBER

This invention relates generally to an intermediate toner transfer member suitable for use in an electrostatographic printing machine, especially a liquid developer type printing machine. More specifically, the present invention is directed to an intermediate toner transfer member having an outer layer which includes hydrocarbon chains covalently bonded to the backbone of a haloelastomer, thereby improving compatibility of a liquid developer with the surface of the intermediate member.

In the liquid development process there are three major steps. The first step involves creation of a latent image on a receptor which is then developed with a liquid toner. In the second step, the image is electrostatically transfered to an intermediate toner transfer member where it is conditioned which means that excess fluid from the image is removed and the image is stablized. The third step involves the transfer of the conditioned image to the paper where it is fixed using pressure and/or temperature. The problem which this invention addresses relates to the above mentioned third step. The intermediate toner transfer member is generally comprised of a substrate and a conformable layer. The conformable layer is needed because it helps in image conditioning and image fixing steps. To have 100% transfer efficiencies one needs a thin layer of lubricant between the conformable layer of the intermediate toner transfer member and the image. In the absence of such a lubricant sometimes 100% transfer efficiencies are not possible which results in the image offset to the surface of the intermediate toner transfer member. The major thrust of the invention is to build such a lubricant layer through chemical bonding onto the surface of the transfer member which is useful for a liquid development process and also a dry development process where there is no image conditioning of the dry developed images.

Examples of an intermediate toner transfer member can be found in the following documents:

Hartley et al., U.S. Pat. No. 4,853,737, discloses rolls having an outer layer comprising cured fluoroelastomer containing pendant polydiorganosiloxane segments that are covalently bonded to the backbone of the fluoroelastomer. The outer layer provides a release surface that is adhesive to heat-softenable toner material.

Till, U.S. Pat. No. 5,233,397, discloses a liquid developer type electrophotographic printing machine which use an intermediate toner transfer belt made from silicone rubber or VITON™.

Buchan et al., U.S. Pat. No. 3,893,761, discloses an intermediate transfer belt having a polyimide film substrate coated with 0.1 to 10 mils of silicone rubber or a fluoroelastomer.

Till et al., U.S. Pat. No. 4,684,238 and Radulski et al., U.S. Pat. No. 4,690,539, disclose single layer intermediate transfer belts composed of polyethylene terephthalate or propylene material which are employed in liquid development methods and apparatus.

Berkes et al., U.S. Pat. No. 5,119,140, discloses a single layer intermediate transfer belt fabricated from clear TEDLAR™, carbon loaded TEDLAR™ or pigmented TEDLAR™.

Nishise et al., U.S. Pat. No. 5,099,286, discloses an intermediate transfer belt comprising electrically conductive urethane rubber as the substrate and a layer of polytetrafluoroethylene.

Bujese, U.S. Pat. No. 5,150,161, discloses suitable materials for laminate intermediate transfer members in a color printing apparatus, reference for example col. 7, line 48 to col. 8, line 38, and col. 11, lines 46–53.

Badesha et al., U.S. Pat. No. 5,340,679 (Attorney Docket No. D/92564), discloses an intermediate toner transfer component comprised of a substrate and thereover a coating comprised of a volume grafted elastomer, which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator.

Bujese et al., U.S. Pat. No. 5,132,743, discloses an intermediate transfer member which employs a conductive fluorosilicone layer.

SUMMARY OF THE INVENTION

It is an object of the present invention to provide intermediate toner transfer members suitable for liquid development systems, and optionally dry development systems.

It is also an object in embodiments to provide imaging apparatus and intermediate toner transfer members exhibiting high toner transfer efficiencies to and from the intermediate transfer members.

It is a further object in embodiments to enable generation of full color images with high color fidelity in imaging apparatus employing an intermediate toner transfer member.

It is an additional object to provide new intermediate toner transfer members which possess one or more of the following attributes: excellent chemical stability wherein the toner release layer (i.e., the outer layer) minimally reacts or does not react with the components of the liquid and dry toners and developers including the toner resin, pigment(s)/dye(s), charge control additive(s), charge director(s), and carrier fluid; low surface energy; suitable dielectric thickness; suitable electrical conductivity; suitable thermal conductivity; good physical and mechanical stability; and good conformability.

These objects and others are accomplished in embodiments by providing an intermediate toner transfer member comprising:

(a) a substrate; and (b) an outer layer comprised of a haloelastomer having pendant hydrocarbon chains covalently bonded to the backbone of the haloelastomer.

There is further provided in embodiments of the present invention an electrostatographic printing apparatus comprising:

(a) an imaging member for recording a latent image;

(b) a developing device including a liquid developer for developing the latent image with a toner composition to form a toner image;

(c) an intermediate toner transfer member, positioned adjacent the imaging member, comprising:

(i) a substrate, and (ii) an outer layer comprised of a haloelastomer having pendant hydrocarbon chains covalently bonded to the backbone of the haloelastomer; and (d) a transfer apparatus for transferring the toner image from the imaging member to the intermediate toner transfer member.

BRIEF DESCRIPTION OF THE DRAWINGS

Other aspects of the present invention will become apparent as the following description proceeds and upon reference to the Figure which represent an illustrative schematic, elevational view of a color electrostatographic printing machine

DETAILED DESCRIPTION

In the outer layer of the instant intermediate toner transfer member, hydrocarbon chains are covalently bonded to the backbone of a haloelastomer. Such hydrocarbon chains are appended to the backbone of the haloelastomer as opposed to being an integral part of that backbone as would be the case in a random or block copolymer comprising hydrocarbon segments and haloelastomer segments. Accordingly, the hydrocarbon chains are referred to herein as being pendant hydrocarbon chains.

The hydrocarbon chains may be dispersed, preferably substantially uniformly, over the entire outer surface area of the outer layer. As used herein, the phrase "surface graft" refers to the presence of the pendant hydrocarbon chains at the surface of the outer layer to a depth less than the entire thickness of the outer layer. The depth of the surface graft ranges for example from about 100 to about 250 angstroms, and preferably from about 150 to about 200 angstroms. As used herein, the term "volume graft" refers to the presence of the pendant hydrocarbon chains in the entire thickness of the outer layer.

The hydrocarbon chains can be covalently bonded to the haloelastomer by any suitable method. For example, the hydrocarbon chains have one or more functional end groups and the general reaction mechanism involves the dehydrohalogenation of the haloelastomer, thereby creating double bond sites, with subsequent nucleophilic insertion of the functional end groups of the hydrocarbon chains at the double bond sites. In the surface graft case, one can take cured or uncured haloelastomer films or coatings and surface treat it with the grafting agent which may be for example an amino terminated hydrocarbon chain such as hexadecylamine. The amino functionality may be a primary, secondary, or tertiary amine as described herein. The main reaction is as stated above involving dehydrohalogenation followed by the nucleophilic attack of the amino functionality to the reactive sites which in this case are carbon carbon double bonds. As a result the graft is on the surface only where the surface graft is done on the already formed toner transfer member. To the contrary, volume graft is made in solution. In the volume graft case, the basic steps are the same which are dehydrohalogenation followed by nucleophilic attack which results in the formation of the covalent bonds between the haloelastomer and the amino terminated hydrocarbon chain. The volume graft solution is then used to fabricate the outer layer of the toner transfer member which is then cured. In volume graft, there is enough graft on the surface in addition to amino norpar being present through out the bulk of the haloelastomer for 100% toner transfer efficiencies.

Suitable haloelastomers include any suitable halogen containing elastomer such as a chloroelastomer, a bromoelastomer, a fluoroelastomer, or mixtures thereof. Fluoroelastomer examples include those described in detail in Lentz, U.S. Pat. No. 4,257,699, as well as those described in Eddy et al., U.S. Pat. No. 5,017,432 and Ferguson et al., U.S. Pat. No. 5,061,965, the disclosures of which are totally incorporated by reference. As described therein these fluoroelastomers, particularly from the class of copolymers and terpolymers of vinylidenefluoride hexafluoropropylene and tetrafluoroethylene, are known commercially under various designations as VITON A™, VITON E™, VITON E60C™, VITON E430™, VITON 910™, VITON GH™ and VITON GF™. The VITON™ designation is a Trademark of E. I. Dupont deNemours, Inc. Other commercially available materials include FLUOREL 2170™, FLUOREL 2174™, FLUOREL 2176™, FLUOREL 2177™ and FLUOREL LVS 76™, FLUOREL™ being a Trademark of 3M Company. Additional commercially available materials include AFLAS™ a poly(propylene-tetrafluoroethylene), FLUOREL II™ (LII900) a poly(propylene-tetrafluoroethylene-vinylidenefluoride) both also available from 3M Company as well as the TECNOFLON™ compositions identified as FOR-60KIR, FOR-LHF, NM, FOR-THF, FOR-TFS, TH, TN505 available from Montealison Specialty Chemical Co. Typically, these fluoroelastomers are cured with a nucleophilic addition curing system, such as a bisphenol crosslinking agent with an organophosphonium salt accelerator as described in further detail in the above referenced Lentz Patent and in U.S. Pat. No. 5,017,432. In a particularly preferred embodiment, the fluoroelastomer is one having a relatively low quantity of vinylidenefluoride, such as in VITON GF™, available from E. I. Dupont deNemours, Inc. The VITON GF™ has 35 weight percent vinylidenefluoride, 34 weight percent hexafluoropropylene and 29 weight percent tetrafluoroethylene with 2 weight percent cure site monomer. It is generally cured with bisphenol phosphonium salt, or a conventional aliphatic peroxide curing agent.

It is believed that some of the aforementioned haloelastomers and others that can be selected have the following formulas:

VITON E-45 ™

$$\left(CH_2-CF_2\right)_x\left(\overset{\overset{CF_3}{|}}{C}F-CF_2\right)_y$$

VITON GF ™

$$\left(CH_2-CF_2\right)_x\left(\overset{\overset{CF_3}{|}}{C}F-CF_2\right)_y\left(CF_2-CF_2\right)_z\left(XBr\right)_w$$

AFLAS ™

$$\left(\overset{\overset{CH_3}{|}}{C}H-CH_2\right)_x\left(CF_2-CF_2\right)_y$$

FLUOREL I ™

$$\left(CH_2-CF_2\right)_x\left(\overset{\overset{CF_3}{|}}{C}F-CF_2\right)_y\left(CF_2-CF_2\right)_z$$

FLUOREL II ™

$$\left(CH_2-CF_2\right)_x\left(\overset{\overset{CH_3}{|}}{C}H-CH_2\right)_y\left(CF_2-CF_2\right)_z$$

TECHNOFLON ™

$$\left(CH_2-CF_2\right)_x\left(\overset{\overset{CF_3}{|}}{C}F-CF_2\right)_y\left(CF_2-CF_2\right)_z$$

wherein the subscripts, such as x, y, and z, represent the repeating segments. Generally, x, y, and z each can vary from 1 to 90 weight percent, and preferably from 20 to 35 weight percent. The subscript vv may be about 2 weight percent.

Unless otherwise indicated, the discussion herein of the hydrocarbon chains refers to the unreacted form. Each of the hydrocarbon chains (excluding any carbon atoms which may be in the functional groups) has for example from about 6 to about 14 carbon atoms, and preferably from about 8 to about 12 carbon atoms. The hydrocarbon chains are preferably saturated such as allcanes like hexane, heptane, decane, and the like. Each hydrocarbon chain has one, two, or more functional groups, a functional group coupled to for instance an end carbon atom, to facilitate covalent bonding of the hydrocarbon chain to the backbone of the haloelastomer. It is preferred that each hydrocarbon chain has only one functional end group. The functional group or groups may be for instance —OH, —$NH_2$, —NRH, —SH, —$NHCO_2$, where R is hydrogen or a lower alkyl having for example from 1 to 4 carbon atoms. The hydrocarbon chains bonded to the haloelastomer can be similar or identical to the carrier fluids conventionally employed in liquid developers.

The outer layer of the intermediate toner transfer member has a thickness ranging for example from about 0.5 to about 50 mils, preferably from about 2 to about 10 mils, and more preferably about 5 mils. The outer layer may include conductive particles in the following illustrative amounts: about 3% to about 20% by weight, preferably about 5% to about 15% by weight, and more preferably about 10% by weight, based on the weight of the outer layer. The conductive particles may be for example carbon black, metal fibers, or powder particles of preferably sub-micron size to ensure good conductive linking throughout the material and for a good distribution during compounding. The metal fibers or powder particles may be aluminum, silver, or graphite. The conductive particles may have an arithmetic mean of the particle diameter from about 20 to about 30 millimicrons.

Other adjuvants and fillers may be incorporated in the outer layer in embodiments of the present invention providing they do not adversely affect the integrity of the outer layer. Such fillers may include coloring agents, reinforcing fillers, crosslinking agents, processing aids, accelerators and polymerization initiators. Adjuvants and fillers may be present in the outer layer in an amount ranging for example from about 5% to about 30% by weight, preferably from about 10% to about 15% by weight, based on the weight of the outer layer.

The dehydrohalogenating agent to dehydrohalogenate the haloelastomer may be selected from the group consisting of primary, secondary and tertiary aliphatic and aromatic amines where the aliphatic and aromatic groups have from 2 to 15 carbon atoms, and aliphatic and aromatic diamines and triamines having from 2 to 15 carbon atoms, and more specifically, the dehydrohalogenating agent is a primary aliphatic amine such as an alkyl amine having up to 19 carbon atoms. The dehydrohalogenating agent, which attacks the haloelastomer generating unsaturation, is selected from the group of strong nucleophilic agents such as peroxides, hydrides, bases, oxides, etc. The preferred agents are selected from the group consisting of primary, secondary and tertiary, aliphatic and aromatic amines, where the aliphatic and aromatic groups have from 2 to 15 carbon atoms. It also includes aliphatic and aromatic diamines and triamines having from 2 to 15 carbon atoms where the aromatic groups may be benzene, toluene, naphthalene or anthracene etc. It is generally preferred for the aromatic diamines and triamines that the aromatic group be substituted in the ortho, meta and para positions. Typical substituents include lower alkylamino groups such as ethylamino, propylamino and butylamino with propylamino being preferred. Specific amine dehydrohalogenating agents, useful for instance dehydrofluorination, include N-(2-aminoethyl-3-aminopropyl)-trimethoxy silane, 3-(N-strylmethyl-2-aminoethylamino) propyltrimethoxy silane hydrochloride and (aminoethylamino methyl) phenethyltrimethoxy silane.

There may be an adhesive layer between the outer layer and the substrate. The adhesive layer may have a thickness ranging for example from about 0.1 mil to about 3 mils, and more preferably from about 1 mil to about 2 mils. Examples of adhesives include: THIOXON 403/404™ and THIOXON 330/301™ both available from Morton International of Ohio; GE-2872-074™ available from the General Electric Company which is believed to be a copolymer of polyimide and siloxane; a silane coupling agent such as Union Carbide A-1100 which is an amino functional siloxane; epoxy resins including bisphenol A epoxy resins available for example from Dow Chemical Company such as Dow TACTIX 740™, Dow TACTIX 741™, and Dow TACTIX 742™, and the like, optionally with a crosslinker or curative such as Dow H41 available from the Dow Chemical Company.

Examples of materials for the substrate include polyvinyl fluoride, such as TEDLAR®, available from E. I. DuPont de Nemours & Company, where the polyvinyl fluoride can be loaded with conductive or dielectric fillers such as carbon particles, titanium dioxide, barium titanate, or any other filler capable of decreasing dielectric thickness; polyvinylidene fluoride, such as KYNAR®, available from Pennwalt Corporation, where the polyvinylidene fluoride can be loaded with conductive or dielectric fillers such as carbon particles, titanium dioxide, barium titanate, or any other filler capable of decreasing dielectric thickness, certain papers, such as Xerox Corporation 4024 paper or Xerox Corporation Series 10 paper, and the like. In addition, metals that can be coated include aluminum, copper, brass, nickel, zinc, chromium, stainless steel, semitransparent aluminum, steel, cadmium, silver, gold, indium, tin, and the like. Metal oxides, including tin oxide, indium tin oxide, and the like, are also suitable. Any other material having the desired charge relaxation characteristics can also be employed. Fillers employed to alter the relaxation time of a material may be present in any amount necessary to effect the desired relaxation time; typically, fillers are present in amounts of from 0 to about 80 percent by weight. Preferably, the substrate is a metal, a metal oxide, a thermoplastic or a thermosetting organic film, including the materials disclosed herein. In embodiments, the substrate comprises polyimide, optionally including carbon black.

The intermediate toner transfer member can be of any suitable configuration including a sheet, a web, a foil, a strip, a coil, a cylinder, a drum, an endless belt, an endless mobius strip, a circular disc, or the like. Typically, the transfer member has a thickness of from about 2 to about 10 mils.

The intermediate member of the present invention in embodiments can have a charge relaxation time of no more than about $2\times10^2$ seconds to ensure efficient toner image transfer from the intermediate to the substrate. The lower limit of suitable charge relaxation times is theoretically unlimited, and conductive materials, such as metals, can be employed as the transfer member. While not being limited by any theory, however, it is believed that the lower limit on the charge relaxation time for an intermediate transfer member in any given situation will be determined by the conductivity of the receiving substrate to which the toner image is ultimately transferred. Specifically, no shorting should occur between the intermediate transfer component and the substrate around the toner piles constituting the image, since shorting would result in little or no transfer field to effect transfer from the intermediate to the substrate. Typically, for transfer to paper, the charge relaxation time is from about $1\times10^3$ seconds to about $2\times10^2$ seconds. The charge relaxation time ($\tau$) of a material is generally a function of the dielectric constant (K), the volume resistivity ($\rho$) of that material, and the permittivity of free space ($\epsilon_0$, a constant equal to $8.854\times10^{-14}$ farads per centimeter), wherein $\tau=K\epsilon_{0\rho}$.

By covalently bonding hydrocarbon chains to the haloelastomer in the outer layer of the intermediate member, the present invention creates a surface on the intermediate member which is compatible with the liquid developer. Moreover, the intermediate member does not chemically react with the components of the liquid developer. In the liquid development process it is desirable that the outer layer of the toner transfer member swells slightly with liquid ink. The desired swell is anywhere from about 2 to about 10% by volume. More than this level of swell adversely impacts the physical properties of the transfer member. The reason for the need for this little swell is that the image does not adhere to the surface of the outer layer of the transfer member and therefore the image is transferred without offset. The surface graft allows the very top surface to swell with the ink to levels close to about 5% by volume, all other desired properties including electrical and mechanical of the transfer member being unaffected. This level of swell enables 100% toner transfer efficiency. To the contrary, the toner transfer member without the surface graft have a toner offset problem where the toner transfer efficiency is less than 100%.

The following discussion provides a general description of the operation of a liquid developer type electrostatographic printing machine which incorporates the instant intermediate toner transfer member. In embodiments, the present intermediate member can be employed in a dry developer type electrostatographic printing machine.

Turning now to the Figure, a photoreceptor 100 in the form of an endless belt is rotated along a curvilinear path defined by rollers 98 and 99. The photoreceptor 100 preferably includes a continuous multi-layered belt including a substrate, an electrically conductive layer, an optional adhesive layer, an optional hole blocking layer, a charge generating layer, a charge transport layer, and, in some embodiments, an anti-curl backing layer. Initially, belt 100 is charged to a uniform potential at a charging station by charging unit 101*a*, which typically includes a corona generating device capable of spraying ions onto the surface of the photoreceptor 100 to produce a relatively high, substantially uniform charge thereon.

After a uniform charge is placed on the surface of the photoreceptor 100, the electrostatographic printing process proceeds by either inputting a computer generated color image into an image processing unit 44 or, for example, by placing a color input document 10 to be copied on the surface of a transparent imaging platen 112. A scanning assembly preferably comprising a high powered light source 13, mirrors 14*a*, 14*b* and 14*c*, a series of lenses (not shown), a dichroic prism 15 and a plurality of charge-coupled devices (CCDs) 117 operating in association with one another is provided, whereby light from the light source 13 is directed onto the input document 10 with the light reflected from the color document 10 being transmitted to the CCDs 117. The reflected light is separated into the three primary colors by the dichroic prism 15 such that each CCD 117 provides an analog output voltage which is proportional to the intensity of the incident light of each of the primary colors. Thereafter, the analog signal from each CCD 117 is converted into a digital signal corresponding individual picture elements or so-called pixels making up the original input document. These digital signals, which represent the blue, green, and red density signals, are inputted into the image processing unit 44 where they are converted into individual bitmaps representing the color components of each pixel (yellow (Y), cyan (C), magenta (M), and black (Bk)), the receptive values of exposure for each pixel, and the color separation therebetween. The image processing unit 44 can store bitmap information for subsequent images or can operate in a real time mode. The image processing unit 44 may also contain a shading correction unit, an undercolor removal unit (UCR), a masking unit, a dithering unit, a gray level processing unit, and other imaging processing sub-systems known in the art.

The digital output signals generated by the image processing unit 44 described hereinabove are transmitted to a series of individual raster output scanners (ROSs) 20*a*, 20*b*, 20*c* and 20*d* for writing complementary color image bitmap information onto the charged photoreceptor 100 by selectively erasing charges thereon. Each ROS writes the image information in a pixel by pixel manner. It will be recognized that the present description is directed toward a Recharge, Expose, and Develop (READ) process, wherein the charged photoconductive surface of photoreceptor 100 is serially exposed to record a series of latent images thereon corresponding to the substractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD) wherein charged areas are developed, can be employed as will be described.

As previously noted, the present intermediate member is utilized for carrying out the development process utilizing liquid developer materials, where the liquid developer units are depicted schematically at reference numerals 103*a*, 103*b*, 103*c* and 103*d*. Each developer unit transports a different color liquid developer material into contact with the electrostatic latent image so as to develop the latent image with pigmented toner particles to create a visible image. By way of example, developer unit 103*a* transports cyan colored liquid developer material, developer unit 103*b* transports magenta colored liquid developer material, developer unit 103*c* transports yellow colored liquid developer material, and developer unit 103*d* transports black colored liquid developer material. Each different color developer material comprises pigmented toner particles disseminated through a liquid carrier, wherein the toner particles are charged to a polarity opposite in polarity to the charged latent image on the photoconductive surface such that the toner particles pass by electrophoresis to the electrostatic latent image to create a visible developed image thereof. Each of the developer units 103*a*, 103*b*, 103*c* and 103*d* are substantially identical to one another.

Generally, the liquid carrier medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes, including hydrocarbons, such as high purity allcanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The toner particles can be any pigmented particle compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and U.S. application Ser. No. 08/268,608 the disclosures of each of which are totally incorporated herein by reference. The toner particles should have an average particle diameter from about 0.2 to about 10 microns, and preferably from about 0.5 to about 2 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethylacrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (CibaGeigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer, a charge control additive sometimes referred to as a charge director may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

After image development, the liquid image on the photoconductor may be conditioned to compress the image and remove some of the liquid carrier therefrom, as shown, for example, by U.S. Pat. No. 4,286,039, among various other patents. An exemplary apparatus for image conditioning is shown at reference numeral 21*a*, 21*b*, 21*c* and 21*d*, each comprising a roller, similar to roller 18*a* which may include a porous body and a perforated skin covering. The roller 18*a* is typically biased to a potential having a polarity which inhibits the departure of toner particles from the image on the photoreceptor 100 while compacting the toner particles of the image onto the surface of the photoreceptor. In this exemplary image conditioning system, a vacuum source (not shown) is also provided and coupled to the interior of the roller for creating an airflow through the porous roller body to draw liquid from the surface of the photoreceptor, thereby increasing the percentage of toner solids in the developed image. In operation, roller 18*a* rotates against the liquid image on belt 100 such that the porous body of roller 18*a* absorbs excess liquid from the surface of the image through the pores and perforations of the roller skin covering. The vacuum source, typically located along one end of a central cavity, draws liquid through the roller skin to a central cavity for depositing the liquid in a receptacle or some other location which permits either disposal or recirculation of the liquid carrier. The porous roller 18*a* is thus continuously discharged of excess liquid to provide continuous removal of liquid from the image on belt 100. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

After image conditioning of the first developed image, the image on belt 100 is advanced to a lamp 34*a* where any residual charge left on the photoreceptive surface is extinguished by flooding the photoconductive surface with light from lamp 34*a*. Thereafter, imaging and development are repeated for subsequent color separations by first recharging and reexposing the belt 100, whereby color image bitmap information is superimposed over the previous developed latent image. Preferrably, for each subsequent exposure an adaptive exposure processor is employed that modulates the exposure level of the raster output scanner (ROS) for a given pixel as a function of the toner previously developed at the pixel site, thereby allowing toner layers to be made independent of each other, as described in U.S. application Ser. No 07/927,751. The reexposed image is next advanced through a development station and subsequently through an image conditioning station and each step is repeated as previously described to create a multi layer image made up of black, yellow, magenta, and cyan toner particles as provided via each developing station 103*a*, 103*b*, 103*c* and 103*d*. It should be evident to one skilled in the art that the color of toner at each development station could be in a different arrangement.

After the multi layer image is created on the photoreceptor, it is advanced to an intermediate transfer station where charging device 111 generates a charge for electrostatically transferring the image from the photoreceptor 100 to an intermediate transfer member 110 The intermediate member 110 may be in the form of either a rigid roll or an endless belt, as shown in the Figure, having a path defined by a plurality of rollers in contact with the inner surface thereof. The intermediate member preferably comprises a multilayer structure comprising a substrate layer having a thickness greater than 0.1 mm and a resistivity of about $10^6$ ohm-cm and insulating top layer having a thickness less than 10 micron, a dielectric constant of approximately 10, and a resistivity of about $10^{13}$ ohm-cm. The top layer also has an adhesive release surface. It is also preferred that both layers have a similar hardness of less than about 60 durometer. The intermediate transfer member is typically dimensionally stable in nature for providing uniform image deposition which results in a controlled image transfer gap and better image registration.

The multi layer image on the intermediate transfer member 110 may be image conditioned in a manner similar to the image conditioning described hereinabove with respect to the developed image on the photoreceptor 100 by means of a roller 120 which conditions the image by reducing fluid content while inhibiting the departure of toner particles from the image as well as compacting the toner image. Preferably, roller 120 conditions the multi layer image so that the image has a toner composition of more than 50 percent solids. In addition, the multi layer image present on the surface of the intermediate member may be transformed into a tackified or molten state by heat, as may be provided by a heating element 32. More specifically, heating element 32 heats both the external wall of the intermediate member and generally maintains the outer wall of member 110 at a temperature sufficient to cause the toner particles present on the surface to melt, due to the mass and thermal conductivity of the intermediate member. The toner particles on the surface maintain the position in which they were deposited on the outer surface of member 110, so as not to alter the image pattern which they represent while softening and coalescing due to the application of heat from the exterior of member 110. Thereafter, the intermediate transfer member continues to advance in the direction of arrow 22 to a transfix nip 34 where the tackified toner particle image is transferred, and bonded, to a recording sheet 26 with limited wicking thereby. At the transfix nip 34, the toner particles are forced into contact with the surface of recording sheet 26 by a normal force applied through backup pressure roll 36. Some of the advantages provided by the use of an intermediate transfer member include reduced heating of the recording sheet as a result of the toner or marking particles being pre-melted on the intermediate, as well as the elimination of an electrostatic transfer device for transferring charged particles to a recording sheet.

After the developed image is transferred to intermediate member 110, residual liquid developer material may remain on the photoconductive surface of belt 100. A cleaning station 31 is therefore provided, including a roller formed of any appropriate synthetic resin which may be driven in a direction opposite to the direction of movement of belt 100, to scrub the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from lamp 34*d* in preparation for a subsequent successive imaging cycle. In this way, successive electrostatic latent images may be developed.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE 1

An inventive intermediate toner transfer member was prepared as follows. A dispersion comprising part A of 100 parts by weight Viton GF obtained from DuPont Co., 25 parts by weight of Regal 250 carbon black obtained from Cabot Chemical Co., 15 parts by weight MAGLITE Y™ (MgO) in methyl ethyl ketone ("MIBK") to a 15% solids mixture, and part B of 5 parts of Viton Curative VC50 and 28.3 parts of MIBK. Part B was added to part A and roll milled for 45 minutes. The resulting dispersion was then sprayed on to an endless 2.2 mil thick stainless steel belt which has been previously grit blasted and degreased with solvent, dried and primed with an epoxy adhesive THIXON 300/301™. The resulting belt was then desolvated at ambient conditions for 24 hours and subsequently step cured at 2 hours at 65° C., 4 hours at 77° C., 2 hours at 177° C., and finally 14 hours at 220° C. The resulting dry thickness of the outer layer was 4 mils.

A surface graff of 1-hexadecylamine was prepared as follows. The belt was soaked for 2 hours in a 20% solution of 1-hexadecylamine available from Aldrich Chemical Co., in hexane. The belt was taken out of the bath, air dried for 5 hours, and heated in an oven for 2 hours which was maintained at 102° C.

The resulting belt was then tested for toner transfer efficiencies by placing it in a laboratory liquid development test fixture. The 1-hexadecylamine grafted toner transfer member consistently showed 100% toner transfer efficiencies as measured by a densitometer RD918 available from Macbeth Inc. of New York. Thus, the inventive transfer member showed excellent characteristics enabling superior transfer of developed xerographic latent images.

COMPARATIVE EXAMPLE

A comparison intermediate toner transfer member was prepared using the same procedures as described in Example 1 except the surface graft of the 1-hexadecylamine was omitted.

The comparison transfer member was then tested for toner transfer efficiencies by placing it in the laboratory liquid development test fixture of Example 1. The comparison transfer member showed poorer toner transfer efficiencies ranging from 94% to 96% as measured by the densitometer RD918.

Other modifications of the present invention may occur to those skilled in the art based upon a reading of the present disclosure and these modifications are intended to be included within the scope of the present invention.

We claim:

1. An intermediate toner transfer member comprising:

(a) a substrate; and (b) an outer layer comprised of a haloelastomer having pendant hydrocarbon chains covalently bonded to the backbone of the haloelastomer, wherein each of the hydrocarbon chains is saturated.

2. The member of claim 1, wherein the substrate is in the shape of an endless belt.

3. The member of claim 1, further comprising an adhesive layer between the substrate and the outer layer.

4. The member of claim 1, wherein the hydrocarbon chains are present in the entire thickness of the outer layer.

5. The member of claim 1, wherein the hydrocarbon chains are present in only a portion of the thickness of the outer layer starting from the outer surface of the outer layer.

6. The member of claim 5, wherein the portion of the outer layer containing the hydrocarbon chains has a thickness ranging from about 100 to about 250 angstroms.

7. The member of claim 1, wherein the haloelastomer is a fluoroelastomer.

8. The member of claim 7, wherein the fluoroelastomer is a terpolymer comprising vinylidenefluoride, hexafluoropropylene, and tetrafluoroethylene.

9. The member of claim 7, wherein the fluoroelastomer is a copolymer comprising vinylidenefluoride and tetrafluoroethylene.

10. The member of claim 1, wherein each of the hydrocarbon chains has from about 6 to about 14 carbon atoms.

11. An electrostatographic printing apparatus comprising:

(a) an imaging member for recording a latent image;

(b) a developing device including a liquid developer for developing the latent image with a toner composition to form a toner image;

(c) an intermediate toner transfer member, positioned adjacent the imaging member, comprising:

(i) a substrate, and (ii) an outer layer comprised of a haloelastomer having pendant hydrocarbon chains covalently bonded to the backbone of the haloelastomer, wherein each of the hydrocarbon chains is saturated; and (d) a transfer apparatus for transferring the toner image from the imaging member to the intermediate toner transfer member.

* * * * *